US007231289B2

(12) United States Patent
Damitz et al.

(10) Patent No.: US 7,231,289 B2
(45) Date of Patent: Jun. 12, 2007

(54) METHOD AND DEVICE FOR OPERATING AN INTERNAL COMBUSTION ENGINE

(75) Inventors: Jens Damitz, Illingen (DE); Joachim Palmer, Korntal-Muenchingen (DE); Horst Wagner, Stuttgart (DE); Michael Kessler, Leonberg-Warmbronn (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/213,600

(22) Filed: Aug. 26, 2005

(65) Prior Publication Data

US 2006/0064226 A1 Mar. 23, 2006

(30) Foreign Application Priority Data

Sep. 23, 2004 (DE) ..... 10 2004 046 083

(51) Int. Cl.
*F02D 41/14* (2006.01)
*F02M 7/00* (2006.01)

(52) U.S. Cl. ..... 701/104; 701/105; 701/115; 123/435

(58) Field of Classification Search ..... 701/103, 701/111, 10, 114, 112, 109, 102, 104, 105, 701/115; 123/435, 406.2, 406.21, 406.22
See application file for complete search history.

(56) References Cited

U.S. PATENT DOCUMENTS 5,131,371 A * 7/1992 Wahl et al. ..... 123/436
6,675,787 B2 * 1/2004 Damitz et al. ..... 123/673
7,012,513 B2 * 3/2006 Frank et al. ..... 340/439

FOREIGN PATENT DOCUMENTS

DE 3916460 C2 * 3/1998
DE 103 05 656 1/2004

* cited by examiner

*Primary Examiner*—Stephen K. Cronin
*Assistant Examiner*—Johnny H. Hoang
(74) *Attorney, Agent, or Firm*—Kenyon & Kenyon LLP

(57) ABSTRACT

A device and a method for controlling an internal combustion engine are provided, in which a first actuating variable of at least one first actuating element is adapted on the basis of a comparison between a first cylinder-specific variable characterizing the combustion process in at least one cylinder and a setpoint value for this variable. On the basis of at least one second variable, at least one deviation value for at least one additional cylinder is determined. Based on this deviation value, a second actuating variable of a second actuating element is adapted.

10 Claims, 2 Drawing Sheets

METHOD AND DEVICE FOR OPERATING AN INTERNAL COMBUSTION ENGINE

FIELD OF THE INVENTION

The present invention relates to a method and a device for controlling an internal combustion engine, in which an actuating variable of an actuating element is adapted.

BACKGROUND INFORMATION

Published German patent document DE 103 05 656 describes a method and a device for controlling an internal combustion engine, in which method, based on the comparison between a first cylinder-specific variable characterizing the combustion process in at least one cylinder and a setpoint value for this variable, an actuating variable of an actuating element is used to influence at least one selected actuating variable. The output signal of a structure-borne noise sensor is used to form the variable. On the basis of the signal from a structure-borne noise sensor, a feature is obtained in this case which is adjusted to a predefined setpoint value.

Cylinder-specific variables that may characterize the combustion process in at least one cylinder are able to be obtained on the basis of a combustion chamber pressure sensor as well. Starting from a structure-borne noise sensor and/or a combustion chamber pressure sensor, various features that characterize the combustion process in at least one cylinder may be obtained and used for the control.

So-called homogeneous and/or partly homogeneous combustion methods may be used in the future in directly injecting combustion engines, e.g., in diesel engines, in order to markedly reduce the particle and nitrogen oxide emissions. The precise observation of a predefined combustion characteristic will be required to comply with emissions, noise and specified consumption requirements. To this end, as described in the above related art, a characteristic quantity characterizing the combustion process is determined on the basis of a cylinder-pressure measurement and/or a structure-borne noise measurement. Hereinafter, this characteristic quantity is also referred to as feature.

The sensor technology and signal conditioning involved in this context, especially for detecting the pressure variables, are cost-intensive. Therefore, there is a need to minimize the cost while simultaneously preserving the advantages of a corresponding closed-loop control and/or open-loop control.

SUMMARY

The present invention provides that, instead of a sensor for each cylinder, a corresponding sensor is provided only at one cylinder, which hereinafter will be designated the lead cylinder. A corresponding feature for this lead cylinder is obtained on the basis of this one sensor and utilized for the closed-loop and/or open-loop control. The other cylinders are adapted to this lead cylinder with the aid of a compensating functionality. To this end, utilizing the compensating functionality, deviation values are ascertained on the basis of at least one second variable. These deviation values characterize the deviation of the particular cylinder from the lead cylinder.

This means that the lead cylinder is subject to a combustion characteristic control, which is based either on the cylinder pressure signal or a structure-borne noise signal. Using additional sensors, e.g., sensors for the rotational speed and/or a lambda signal, the deviations of the other cylinders from the lead cylinder are detected and cylinder-specific control interventions are carried out at the other cylinders by suitable compensating functions on the basis of this ascertained deviation. This compensating function may be implemented also on the basis of other measuring variables and/or variables derived from the measured variables.

The adaptation as a function of the deviation values may be implemented in different ways. For example, cylinder-specific input variables of the controls such as the setpoint torque value or the control start setpoint value may be corrected in an additive and/or multiplicative manner. As an alternative, it may also be provided that the deviation values are supplied to the controls as additional input variables.

In an example embodiment of the present invention, a so-called AQ50 control may be used, i.e., if the crankshaft angle at which 50% of the entire energy converted in the combustion has been released is ascertained. This angular position is adjusted to a predefined setpoint value.

As an alternative, it is also possible to use not one, but a plurality of lead cylinders. In V-engines, for example, it may be provided to combine a plurality of cylinders to form a so-called bank, each bank of cylinders being assigned a lead cylinder.

DETAILED DESCRIPTION

Figure 1:
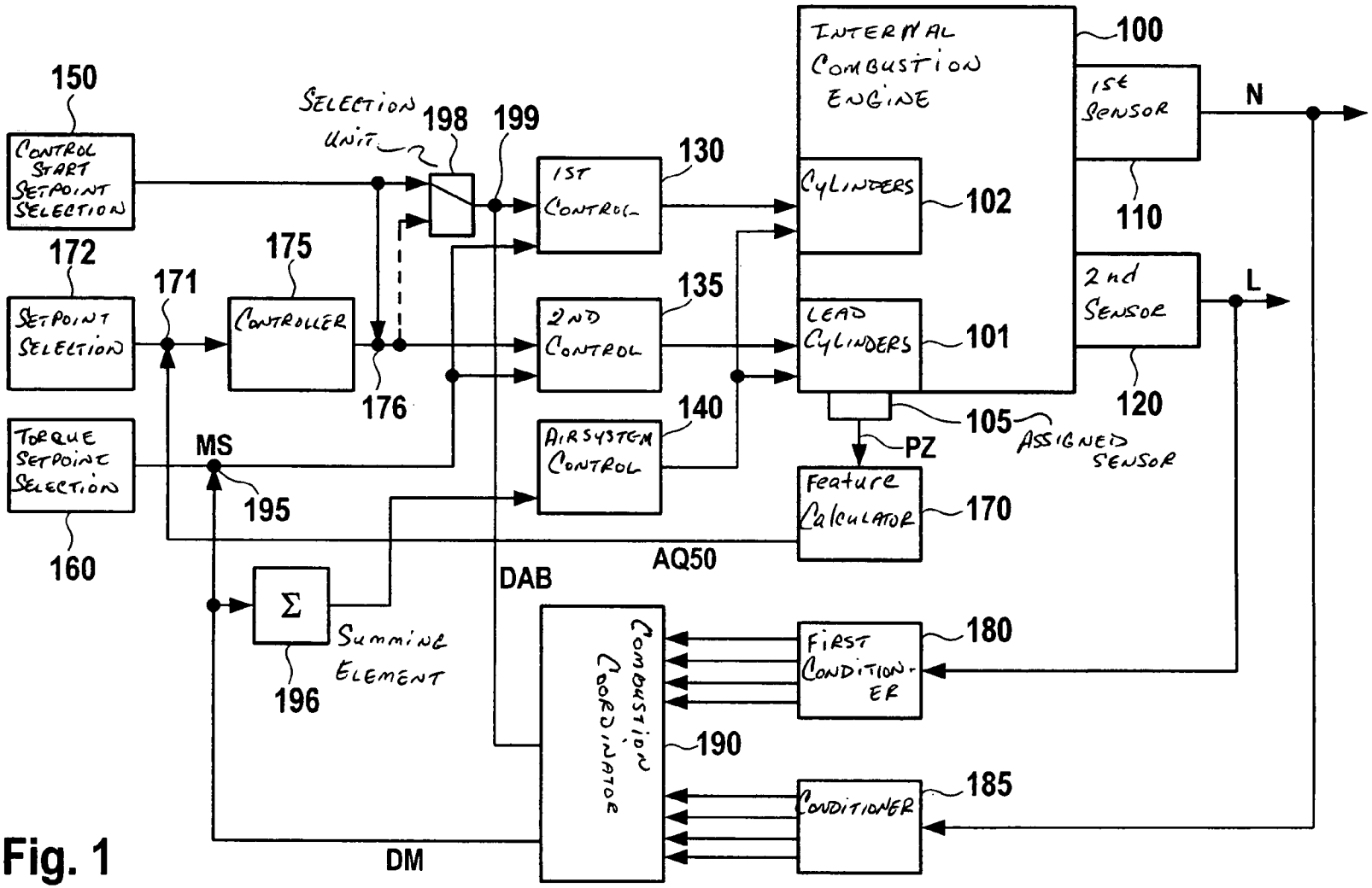
FIG. 1 is a block diagram illustrating an example embodiment of a system for implementing an example method according to the present invention.

An internal combustion engine, which is denoted by reference numeral 100 in FIG. 1, includes at least one so-called lead cylinder 101 and further cylinders 102. Lead cylinder 101 has an assigned sensor 105, which emits a signal that characterizes the combustion process. In the exemplary embodiment described below, this is a sensor which detects the pressure in the combustion chamber of the lead cylinder. As an alternative to the combustion chamber pressure sensor, other sensors may be utilized, on the basis of whose signals similar features may be derived. A structure-borne noise sensor, for example, may be used.

Furthermore, a first sensor 110 is provided which supplies an rpm signal N. A second sensor 120 provides a signal L of the oxygen concentration in the exhaust gas.

Remaining cylinders 102 are assigned a first control 130, which controls the injection of fuel into remaining cylinders 102. Lead cylinder 101 is assigned a second control 135 which controls the injection into the lead cylinder. Controls 130 and 135 are provided to carry out at least one influencing of the start of fuel injection. An influencing of the duration of fuel injection is normally provided as well. Furthermore, an air system control 140 is provided which controls the air quantity that is supplied to the individual cylinders.

A control start setpoint selection 150 specifies to the first and second controls 130 and 135 a setpoint value ABS that characterizes the desired control start of the injection. A torque setpoint selection 160 provides a setpoint value MS for the desired torque to controls 130 and 135. Signal MS reaches first control 130 via a node 195. An output signal DAB from a combustion coordinator 190 is available at the second input of node 199.

On the basis of control start setpoint value ABS, corrected by correction value DAB, and torque setpoint value MS, first control 130 and second control 135 calculate control signals for actuators in the region of the individual cylinders to specify the injection start and/or the injection end, and thus the injection quantity. Furthermore, air system control 140 controls the air quantity supplied to the internal combustion engine.

On the basis of signal PZ from sensor 105, a feature calculator 170 calculates a feature AQ50 that characterizes the actual course of combustion. This signal AQ50 reaches a node 171 at whose second input the output signal of an AQ50 setpoint selection 172 is available. The output signal of node 171, which represents the difference between AQ50 setpoint selection and AQ50, is applied to an AQ50 controller 175. The output signal of AQ50 controller 175 arrives, via a node 176, at second control 135, which controls the injection into the lead cylinder.

Available at the second input of node 176 is output signal ABS of control start setpoint selection 150. In an alternative embodiment, it is provided that the output signal of AQ50 controller 175 and the output signal of control start setpoint selection 150 reach, via a selection unit 198, node 199 and then first control 130.

Output signal L of sensor 120 arrives at combustion characteristic coordinator 190 via a first conditioner 180. Analogously, output signal N from sensor 110 also arrives at combustion characteristic coordinator 190, by way of a conditioner 185. Output signal DM of the combustion characteristic coordinator 190 is applied to the first injection control, and to output signal MS of torque setpoint selection 160 via node 195. Furthermore, output signal DM reaches air system control 140 by way of a summing element 196. Variables DM and DAB correspond to the deviation values that characterize the deviation of the individual cylinders from the lead cylinder.

On the basis of setpoint value ABS of the control start and setpoint value MS for the torque, first control 130 and second control 135 calculate the injection start and the injection quantity that the corresponding cylinders are to meter. To achieve a precise control, lead cylinder 101 is assigned a combustion chamber pressure sensor 105. On the basis of signal PZ from sensor 105, feature calculator 170 calculates a feature AQ50 that characterizes the actual combustion process.

Different variables derived from the combustion chamber pressure signal and/or the structure-borne noise signal may be used as feature AQ50. For instance, the angular position at which specific percentages of the overall energy converted in the combustion have been released may be utilized. A percentage of approximately 10 to 20% may be used as combustion start, for instance. Particularly advantageous is the angular position at which 50% of the energy has been converted; this angular position is used to characterize the combustion center mass. The percentage in the range of 70 to 90% may be used as combustion end.

It is advantageous if the feature is obtained from the energy conversion, i.e., from a variable derived from the pressure characteristic such as the heating profile. It is especially advantageous if the real position of the center mass, i.e., the geometrical area centroid of the heating profile, is ascertained on the basis of the heating profile. Furthermore, the maximum of energy conversion rate dQmax, or percentage threshold values such as 50% dQmax, also may be used as feature. All percentages may relate to the overall combustion of a cycle and/or to partial combustions. As an alternative, features directly derivable from the pressure profile may be used as features. These are, for instance, the position of the pressure maximum, the position of the differential pressure maximum, i.e., the difference between pressure in firing operation and compression pressure, the position of the pressure gradient maximum and percentage thresholds of pressure ratios between pressure and drag pressure.

Feature AQ50 thus obtained is compared to a corresponding setpoint value of setpoint selection 172, the system deviation being supplied to AQ50 controller 175. This controller ascertains the correction value by which the control start and/or the injection quantity is/are to be corrected so as to attain the corresponding setpoint value.

In an example embodiment, only the control of the lead cylinder is modified on the basis of AQ50 controller 175. In a second alternative, it is provided that a corresponding control action be implemented in all cylinders. That means that the control is modified by the same value in all cylinders.

It may be provided that the output signal of controller 175 is added as correction value to setpoint value ABS or to setpoint value MS, or that these setpoint values are corrected by the output signal of the controller.

It may be provided that, in addition to controlling a feature that was detected in one cylinder only, the deviation of the remaining cylinders from this lead cylinder be detected by suitable sensor signals. Rotational speed N and/or lambda signal L may be suitable for this purpose. That means that these corresponding signals are conditioned in first conditioner and second conditioner 180 and 185, respectively, in such a way that the deviations of the individual cylinders from the lead cylinder will be ascertained. Combustion characteristic coordinator 190 then determines correction values DAB by which control start setpoint values ABS of the individual cylinders are corrected, and/or a correction value DM for the individual cylinders by which torque MS is corrected.

This means that a cylinder-specific signal that indicates the deviations of the individual cylinders from the lead cylinder is ascertained on the basis of the lambda and/or the rpm signal. Based on this deviation, combustion characteristic coordinator 190 then determines corresponding correction values DAB or DM for each cylinder to influence the injection into these cylinders. These correction values indicate the deviation of the individual cylinder from the lead cylinder and are also referred to as deviation values. It is particularly advantageous if, in addition or as an alternative, an intervention in the air system takes place on the basis of the individual deviations. This intervention likewise may occur cylinder-specifically or, if this is not possible, globally.

The air quantity, which may be adjusted via the exhaust-gas recirculation rate, the injection start, or the combustion start, and the injected fuel quantity play an important role in partially homogeneous or homogeneous combustion methods. Essential measuring variables to characterize the combustion process are the lambda value, i.e., the oxygen concentration in the exhaust gas, the ignition retard, which is detected by feature AQ50, for example, and rotational speed N or the output torque.

A delayed combustion, i.e., a retarded combustion start, causes a reduction in efficiency, i.e., a smaller torque, in the homogeneous method. The rotational speed drops as a result. Increasing the exhaust recirculation rate leads to a reduction in the oxygen content and a later combustion. Later combustion causes reduced efficiency.

An increased quantity analogously leads to an increase in the rotational speed and a smaller lambda signal. A later control start also results in a later combustion position.

The above-indicated relationships apply both to the average value of all cylinders of the engine and for each individual cylinder. Tolerances, for instance in the injection system or the exhaust-gas recirculation, cause deviations of the measured variables between the individual cylinders.

According to the present invention, the oxygen content in the exhaust gas is directly detected by second sensor 120. This requires that signal L has a time resolution that allows the lambda values to be assigned to the individual cylinders. The generated torque is ascertained indirectly via the highly resolved measurement of rotational speed N using first sensor 110. By measuring the combustion chamber pressure with the aid of sensor 105, the combustion position is determined on the basis of feature AQ50.

Figure 2:
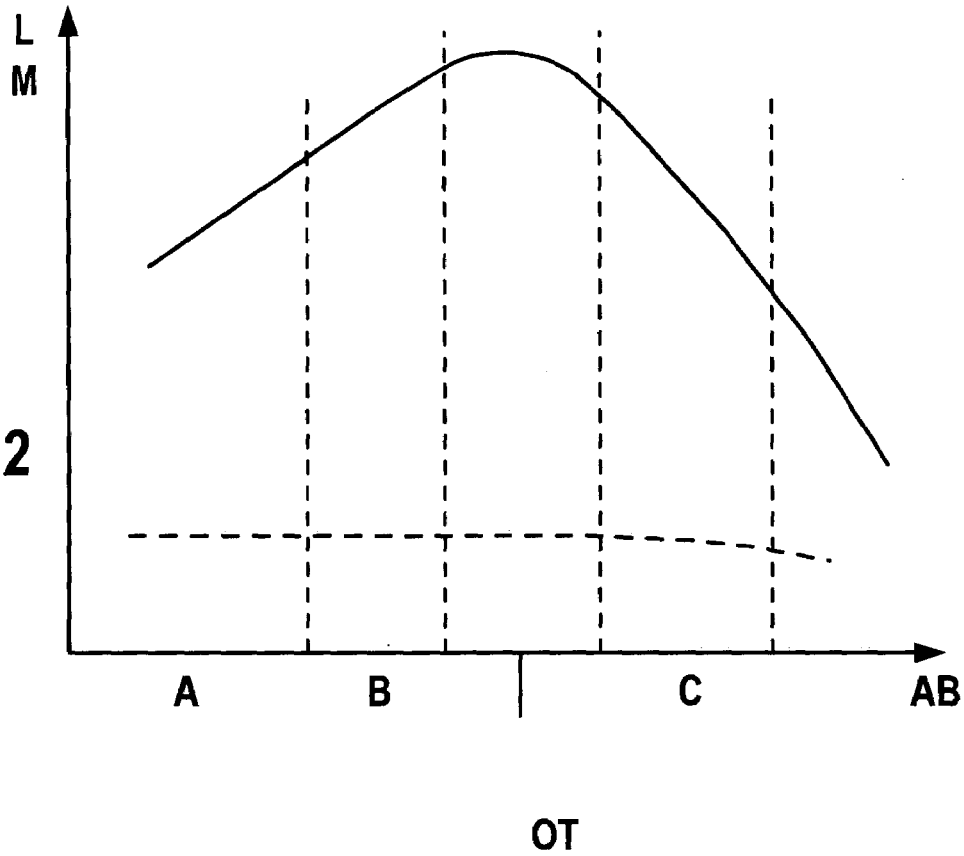
FIG. 2 shows a graph of torque M and oxygen concentration L plotted as a function of control start AB.

In FIG. 2, generated torque M as a function of control start AB has been plotted by a solid line, and value L of the oxygen concentration as a function of control start AB has been plotted by a dot-dash line at a constant fuel quantity. Also marked, by dashed perpendicular lines, are regions A, B and C. Oxygen concentration L is virtually independent of the control start. Torque M increases when the control start is shifted from advanced position in the direction of top dead center. In the region of top dead center, the torque drops again upon further shifting of the control start to retard. In regions A and C there is a virtually linear relationship between the torque and control start.

The function of the torque is strictly monotonic and thus reversible. This applies particularly to regions C and A in which the internal combustion engine is essentially operated in partially homogeneous operation, which means that the combustion start can be inferred from the rotational speed and/or the torque.

According to the present invention, the ambiguity of whether the instantaneous operating point is located in region A or C is able to be resolved as follows. The absolute value of the position of combustion start is ascertained with the aid of the lead cylinder. It is generally assumed that the combustion start for the remaining cylinders is within a similar angular range, i.e., if the lead cylinder is in range A, the remaining cylinders are in range A as well. Another possibility for detecting the range in which the internal combustion engine is operating results from detecting the direction of corrective action, i.e., if the control start is shifted in the retard direction and the torque increases, the internal combustion engine is in range A, but if it decreases, it is in region C.

Figure 3:
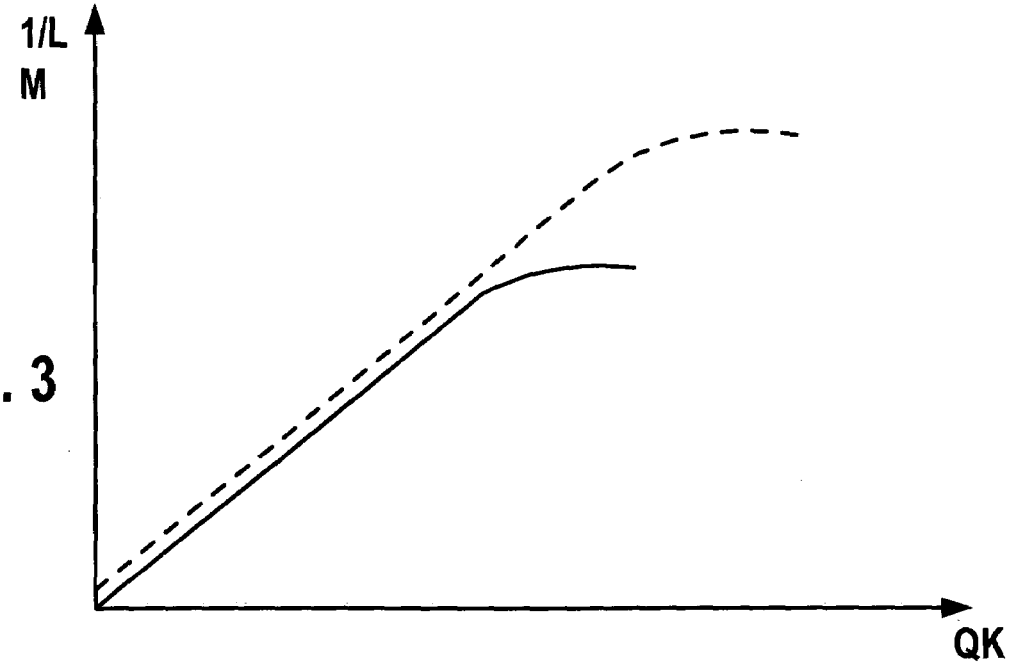
FIG. 3 shows a graph of torque M and inverse of oxygen concentration (1/L) as a function of the fuel quantity injected.

The dependence of the torque and the oxygen concentration is plotted on the basis of a constant control start and increasing fuel quantity, as shown in FIG. 3. Both the reciprocal value of the lambda value (1/L) and the torque increase in a steady, monotonic manner with increasing injection quantity. This means, if the operating point—which is defined by the rotational speed and quantity—of a lead cylinder is known, it is possible to derive the cylinder-specific exhaust-gas recirculation rate and quantity tolerances.

The following Table 1 lists all combinations of the cylinder-specific deviations with respect to the lead cylinder, the effect on measured variable rotational speed N and lambda L being indicated in addition. Plotted in the first row is a fuel quantity that is too small (−), the second row shows a normal fuel quantity (0), and in the third row an excessive fuel quantity (+) has been plotted. The first column under the heading "Charge" shows an excessive cylinder charge (+) the second column shows a normal charge (0), and the third column shows a cylinder charge that is too low (−). N0 or L0 denotes a normal value, N+ or L+ denotes a value that is too high, N++ or L++ denotes a value that is clearly too high, N− or L− denotes a value that is too small, and N−− or L−− denotes a value that is clearly too small. The values are viewed relative to the average value of all cylinders.

TABLE 1

| | Charge | | |
|---|---|---|---|
| Fuel quantity | + | 0 | − |
| − | L++ | L+ | L0 |
| | N0 | N− | N−− |
| 0 | L+ | L0 | L− |
| | N+ | N0 | N− |
| + | L0 | L− | L−− |
| | N++ | N+ | N0 |

It can be gathered that each combination of quantity and charge errors can be assigned an unambiguous combination of measured variables regarding the rotational speed and the lambda value. On the basis of the measured values for rotational speed and lambda, each cylinder is assigned a value pair that is made up of charge and fuel quantity and indicates the deviation from the lead cylinder. In the example embodiment shown, a distinction is made merely between excessive, too low and normal values in the fuel quantity and the charge.

Hereinafter, the cylinder-specific possibilities for controlling the combustion characteristic are described. A torque coordination in intervals A and B, which are run through in conventional lean-combustion operation or in an exhaust-gas aftertreatment with lean main injection, is implemented via the actuating variable control end or injection quantity. In the partially homogeneous combustion method, a very advanced injection usually takes place. In this case, the torque is influenced via the control start and the injection quantity.

To adapt the combustion characteristic to the lead cylinder, a torque adjustment by itself is not sufficient since the torque curve is not reversible across all intervals, i.e., the same torque may be formed in interval A and in interval B via different control starts with different injection quantities. Two alternative methods are available to adjust the combustion characteristic in accordance with the lead cylinder.

In a first example method, the adjustment is implemented both via the torque and the lambda signal. In the second alternative, the torque adjustment is implemented by monitoring the operating state, for instance by precontrol of the operating point and limiting the actuating range of the compensating function, or by identifying the system gain with respect to torque for each cylinder in the working point.

In the following Table 2, the cylinder-specific correction interventions of the actuating variables for coordinating the combustion characteristic are indicated for the first example of the above-mentioned alternatives. The first row lists the values for a fuel quantity that is too low (−), the second row lists the values for a normal fuel quantity (0), and the third row lists values for a fuel quantity that is too high (+). The first column under "Charge" lists the values for a charge that is too high (+), the second column lists the values for a normal charge (0), and in the third column the values are listed for a charge that is too low (−). QK0 or AB0 denote a normal value for the injection quantity and the control start, respectively, QK+ denotes an increased value, and QK− a reduced value for the injection quantity. AB S denotes a value of the control start shifted in the retard direction, and AB F denotes a value of the control start shifted to advance.

TABLE 2

| | Charge | | |
|---|---|---|---|
| Fuel quantity | + | 0 | − |
| − | QK+<br>AB S | QK+<br>AB− | QK−<br>AB F |
| 0 | QK+<br>AB S+ | QK0<br>AB−S | QK−<br>AB F |
| + | QK−<br>AB S | QK−<br>AB 0 | QK−<br>AB F |

Based on the value pair for the deviation of the fuel quantity and the charge read out from table 1, a correction value for adapting the injected fuel quantity and the control start is read out to each cylinder.

This example embodiment provides no cylinder-specific air quantity actuator, so that cylinder-specific air-quantity differences are not able to be compensated directly. Their effect on the combustion characteristic is thus corrected indirectly, i.e., tolerances of the exhaust-gas recirculation rate/charge are compensated by interventions in the control start and the injected fuel quantity. However, it is also conceivable that the charge differences are directly compensated given a corresponding cylinder-specific actuator configuration.

The control strategies pursued by the system shown in FIG. 1 will be described in the following. It is a goal of the control to adjust a predefined combustion characteristic, for instance a particular feature, to a predefined setpoint value, i.e., to adjust it at all cylinders. Several control strategies are possible to attain this goal with the aid of a lead cylinder and a variety of compensating functions.

In a first example method, the cylinder pressure is measured at the lead cylinder, and the corresponding feature, such as AQ50, is determined. The determined actual value is compared to the setpoint value and an actuating variable determined by AQ50 controller 175. The control action of the controller, which was determined solely on the basis of the measured value for the lead cylinder, is also applied to all other cylinders, i.e., the output signal of AQ50 controller 175, as indicated by the drawn-in dashed line, arrives at the remaining cylinders via selection 198, and at lead cylinder 135 directly. This means that the first actuating variable of the first actuating elements of all cylinders is adaptable on the basis of the comparison of a first cylinder-specific variable which characterizes the combustion process in at least one cylinder with a setpoint value for this variable. This control strategy is advantageously utilized in those cases where the lead cylinder is representative of all other cylinders, i.e., the cylinder-specific fault is smaller than the global engine fault. In other words, installation faults of the signal-generating wheel, faults of the air mass meter, etc. predominate compared to cylinder-specific deviations. The compensating functions, i.e., combustion characteristic coordinator 190, provide the adjustment of the combustion characteristic in the remaining cylinders.

In a second example embodiment, it is provided that the control intervention of the lead cylinder is not used for the pre-control of the other cylinders, i.e., the output signal of AQ50 controller 175 reaches only the lead cylinder. Solely the compensating functions of combustion characteristic coordinator 190 generate control interventions for remaining cylinders at control 130. In an advantageous manner, this strategy is applied when the lead cylinder is not representative of all other cylinders, i.e., the cylinder-specific faults are greater than global engine faults. This means that only the first actuating variable of the first actuating element of the lead cylinder is adaptable on the basis of the comparison of a first cylinder-specific variable characterizing the combustion process in at least one cylinder with a setpoint value for this variable.

Moreover, the control strategies of the compensating functions differ in the average control interventions across all cylinders. The following alternative embodiments are possible. In one embodiment, the compensating functions have no control intervention in the lead cylinder, i.e., combustion characteristic coordinator 190 acts only on first control 130 to influence the actuating variables of remaining cylinders 102. That is to say, the average value of the interventions in remaining cylinders 102 corresponds to the intervention in the lead cylinder, i.e., the average value of the actuating variable for cylinders 102 is equal to the actuating variable of lead cylinder 101, which means that the deviation values are determined only for the remaining cylinders.

In an alternative embodiment, it is provided that the compensating function also implements an intervention in the lead cylinder, i.e., the compensating function, i.e., combustion characteristic coordinator 190, treats all cylinders in the same manner. In this case it is provided that the average value of the interventions in all cylinders corresponds to the zero value, which means that, on average, the corrections of the combustion characteristic coordinator assume the value zero, so that the deviation values are determined for all cylinders.

The control interventions of the compensating functions are limited. Control limits result from, for instance, the transmission behavior or system gains for an intervention, as shown in the intervals in FIG. 2, for example. Restrictions also result from noise emissions, i.e., not all desired shifts of the injection start to advanced or retard are possible. In the case of large cylinder-specific deviations, the compensating functions, i.e., the control interventions of the combustion characteristic coordinator, may reach the actuating limit for some cylinders. If the actuating limit is reached, this information will be used to suitably modify the global engine actuating variables of exhaust-gas recirculation. Due to the offset correction that ensues therefrom, the actuating range of the cylinder-specific interventions may be sufficient for the compensating functions. This information is obtained from block 196 on the basis of the cylinder-specific actuating variables of the combustion characteristic coordinator, and supplied to control 140 of the air system. This means that a global engine actuating variable is ascertained on the basis of the deviation values.

What is claimed is:

1. A method for controlling an internal combustion engine, comprising:

adapting a first actuating variable of at least one first actuating element based on a comparison of a first cylinder-specific variable characterizing a combustion process in at least one cylinder with a corresponding setpoint, wherein the first cylinder-specific variable is determined on the basis of an output signal of one of a structure-borne noise sensor and a combustion-chamber pressure sensor, wherein the adapting of the first actuating variable adapts the combustion process in the first cylinder;

ascertaining at least one deviation value for at least one additional cylinder relative to the at least one cylinder on the basis of at least one second variable; and adapting a second actuating variable of a second actuating element on the basis of the at least one deviation value, wherein the adapting of the second actuating variable adapts a second combustion process in the second cylinder based on the deviation of the second cylinder relative to the first cylinder having the combustion process adapted on the basis of the output signal of one of the structure-borne noise sensor and the combustion-chamber pressure sensor.

2. The method as recited in claim 1, wherein the first cylinder-specific variable represents a combustion characteristic.

3. The method as recited in claim 2, wherein the combustion characteristic includes at least one of combustion start, percentage energy-conversion point, combustion speed, pressure gradient and the maximum of a heating profile.

4. The method as recited in claim 1, wherein the first actuating variable of all cylinders of the internal combustion engine is adapted based on the comparison of the first cylinder-specific variable characterizing the combustion process in the at least one cylinder with the corresponding setpoint value.

5. The method as recited in claim 1, wherein the deviation value for the at least one additional cylinder is determined on the basis of at least one variable characterizing a rotational speed and a variable characterizing the oxygen concentration in the exhaust gas.

6. The method as recited in claim 1, wherein a deviation value is determined for each of remaining additional cylinders of the internal combustion relative to the at least one cylinder.

7. The method as recited in claim 1, wherein a plurality of additional cylinders are present in the internal combustion engine, and wherein a deviation value is determined one of: a) only for the at least one additional cylinder; and b) for each of the plurality of additional cylinders.

8. The method as recited in claim 1, wherein a global engine actuating variable is ascertained on the basis of the at least one deviation value.

9. The method as recited in claim 1, wherein at least one of the first actuating variable and the second actuating variable influences one of a fuel quantity to be injected, an air quantity, and an injection start.

10. A device for controlling an internal combustion engine, comprising:

a control unit for adapting a first actuating variable of at least one first actuating element based on a comparison of a first cylinder-specific variable characterizing a combustion process in at least one cylinder with a corresponding setpoint, wherein the first cylinder-specific variable is determined on the basis of an output signal of one of a structure-borne noise sensor and a combustion-chamber pressure sensor, wherein the adapting of the first actuating variable adapts the combustion process in the first cylinder;

an arrangement for ascertaining at least one deviation value for at least one additional cylinder relative to the at least one cylinder on the basis of at least one second variable and adapting a second actuating variable of a second actuating element on the basis of the at least one deviation value, wherein the adapting of the second actuating variable adapts a second combustion process in the second cylinder based on the deviation of the second cylinder relative to the first cylinder having the combustion process adapted on the basis of the output signal of one of the structure-borne noise sensor and the combustion-chamber pressure sensor.

* * * * *